US006900403B2

(12) United States Patent
Ruegenberg

(10) Patent No.: US 6,900,403 B2
(45) Date of Patent: May 31, 2005

(54) OPERATING DEVICE FOR AN ELECTRIC SWITCH COMPRISING A PUSH-BUTTON

(75) Inventor: Roland Ruegenberg, Bad Sobernheim (DE)

(73) Assignee: Methode Electronics Inc., Wiesbaden (DE)

( * ) Notice: Subject to any disclaimer, the term of this patent is extended or adjusted under 35 U.S.C. 154(b) by 0 days.

(21) Appl. No.: 10/477,199

(22) PCT Filed: May 15, 2002

(86) PCT No.: PCT/DE02/01740

§ 371 (c)(1),
(2), (4) Date: Jan. 7, 2004

(87) PCT Pub. No.: WO02/093602

PCT Pub. Date: Nov. 21, 2002

(65) Prior Publication Data

US 2004/0140189 A1 Jul. 22, 2004

(30) Foreign Application Priority Data

May 15, 2001 (DE) ..... 101 23 536

(51) Int. Cl.[7] ..... H01H 3/12
(52) U.S. Cl. ..... 200/341; 200/520
(58) Field of Search ..... 200/167, 308, 200/341, 520, 523, 524, 528, 529, 533, 526, 527, 566

(56) References Cited

U.S. PATENT DOCUMENTS 3,721,789 A * 3/1973 Black ..... 200/308
3,740,501 A * 6/1973 Kiessling et al. ..... 200/16 R
3,852,546 A * 12/1974 Maxwell et al. ..... 200/83 C
4,779,851 A * 10/1988 Bauer et al. ..... 267/64.12
4,985,605 A * 1/1991 Valenzona ..... 200/528
5,055,643 A * 10/1991 Pardini et al. ..... 200/318.2
5,352,128 A * 10/1994 Bricaud ..... 439/188
5,420,387 A * 5/1995 Cummings ..... 200/524
5,669,489 A * 9/1997 von Ende ..... 200/570
5,967,301 A 10/1999 Reed et al. ..... 200/523
5,991,149 A * 11/1999 Tsuneaki et al. ..... 361/629
6,444,932 B1 * 9/2002 Resmalm ..... 200/334

FOREIGN PATENT DOCUMENTS

| | | | |
|---|---|---|---|
| DE | 43 30 502 | 10/1994 | |
| DE | 199 39 692 | 11/2000 | |
| DE | 101 23 536 | 1/2003 | |
| JP | 01130433 | * 11/1987 | ..... 200/341 |
| JP | 06260055 | * 9/1994 | ..... 200/341 |

* cited by examiner

*Primary Examiner*—Elvin Enad
*Assistant Examiner*—Lisa Klaus
(74) *Attorney, Agent, or Firm*—Jacobson Holman PLLC

(57) ABSTRACT

An operating device having a rotatable crank drive which can be actuated by repeatedly pressing and releasing a knob or push-button. The push-button is thus alternately fixed in an operating position, i.e. the out position, and a locking position, i.e. the pressed-in position. A rotatable locking ring which can be axially displaced in an elastic manner and the body of the operating device include crank or link elements which are alternately distributed around the circumference, and in which the knob or push-button can be securely locked in a precise position.

11 Claims, 2 Drawing Sheets

OPERATING DEVICE FOR AN ELECTRIC SWITCH COMPRISING A PUSH-BUTTON

This is a nationalization of PCT/DE02/01740 filed May 15, 2002 and published in German.

BACKGROUND OF THE INVENTION

1. Field of the Invention

The invention relates to an operating device for a flush operating knob with a locking device for the axial locking and unlocking of the operating knob that is extendable under spring load by means of a link guide, especially for the rotary switch of an automobile.

2. Description of the Related Art

It is common to flush-mount rotary knobs, such as those for the adjustment of brightness of lighting devices, in the instrument panel, and to release them from their home position by means of a simple push of the knob in order to activate the operating knob. The knob is then flush again by simply pushing it in, and locked in this position in order to hamper any unintentional activation and adjustment.

Generally, such devices, such as those according to DE 4330502 A, are provided with a stationary link component, in the cardioid of which a laterally traveling link pin, which is connected to the spring-loaded operating knob, engages in such a way that the axial position of the operating knob changes cycles by means of simply pressing between two different stroke positions. All stops and guides are embodied on the body, which appropriately must be designed in a complex and stable manner.

SUMMARY OF THE INVENTION

The present invention is based on the task of increasing locking safety, and improving the bearing of the movable components of the operating device. This task is solved by means of an operating device for a flush operating knob with a locking device for the axial locking and unlocking of the operating knob that is extendable under spring load by means of a link guide, especially for the rotary switch of an automobile, in which the link guide is embodied as a multiple toothed, circumferential link drive, and the body of the operating device, and a locking ring that is axially fixed and pivoted on the operating knob, have successively arranged, circumferentially distributed link elements in which the operating knob can be axially locked.

Such a rotatory link drive generally has push button switches, which change the switching position in gradual cycles, whereby the actual adjustment of the switch is directly activated by pressing the push knob once or several times. A rotating link component is gradually rotated in a defined manner. The same is kinematically connected to active switching elements. In this way, different switching positions can be realized in the various rotary positions of the link component.

The uses of such a drive for the mere purpose of locking and unlocking according to the invention has the advantage that a multitude of support positions can be created along the circular track at the stationary link surfaces, on which the multiple link elements, which are assigned to the push knob, are supported on a broad basis with a correspondingly high input tension. This causes the push knob to be safely fixed in its height position and its axial angular position, without requiring an exact guide inside of the body for this purpose. The lateral buckling of the push knob is thereby reliably avoided. The exterior side of the knob can be maintained in a center position in an opening of the instrument panel without any lateral offset. By means of the large support and gliding panes of the link drive, materials of low strength and improved gliding properties can be utilized.

Advantageous further embodiments of the invention include a locking ring having at least three of the movable link elements equally distributed across its circumference which are supported in the locking position on the fixed link elements of the body. This embodiment fixes the push knob in a manner that is safe from buckling.

According to further embodiments, the fixed link elements are attached at an essentially hollow-cylindrical wall of the body radially facing toward the interior, with the movable link elements of the locking ring protruding radially toward the exterior and engaging into the fixed link elements. Additionally, the fixed link elements may be embodied as upper longitudinal ligaments offset from corresponding lower longitudinal ligaments having frontal accumulation chamfers that face each other, the width of the upper longitudinal ligaments each corresponding to the width of the channels embodied between the lower longitudinal ligaments and vice versa. These embodiments result in a simple, stable, and easy to produce design, whereby an interior molded component can be embodied of two molded inserts that are divided lateral in the direction of the axis.

The present invention may further be embodied such that the fixed link elements of the body continuously extend to an exterior body edge of the hollow-cylindrical wall. The operating device can be attached to an assembly area in an instrument panel in its locked position, and the axial spring-loaded operating knob in its unlocked position can be rushed via a stop shoulder against a collar-like stop of the instrument panel. According to this embodiment, the push knob can be supported free of clearance in its extended state under input tension at a defined height position on the instrument panel, without the body having to be precisely fixed on the instrument panel. This simplifies the configuration of the operating device, as well as its assembly inside of the instrument panel. This procedure is benefited by the fact that the push knob can be anchored particularly safely in its pushed-in position with the aid of the multiple link elements so that the risk of any unintentional unlocking with parts possibly catapulting off is negligible.

BRIEF DESCRIPTION OF THE DRAWINGS

An embodiment example of the invention is illustrated in the drawings, and is explained in further detail as follows.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
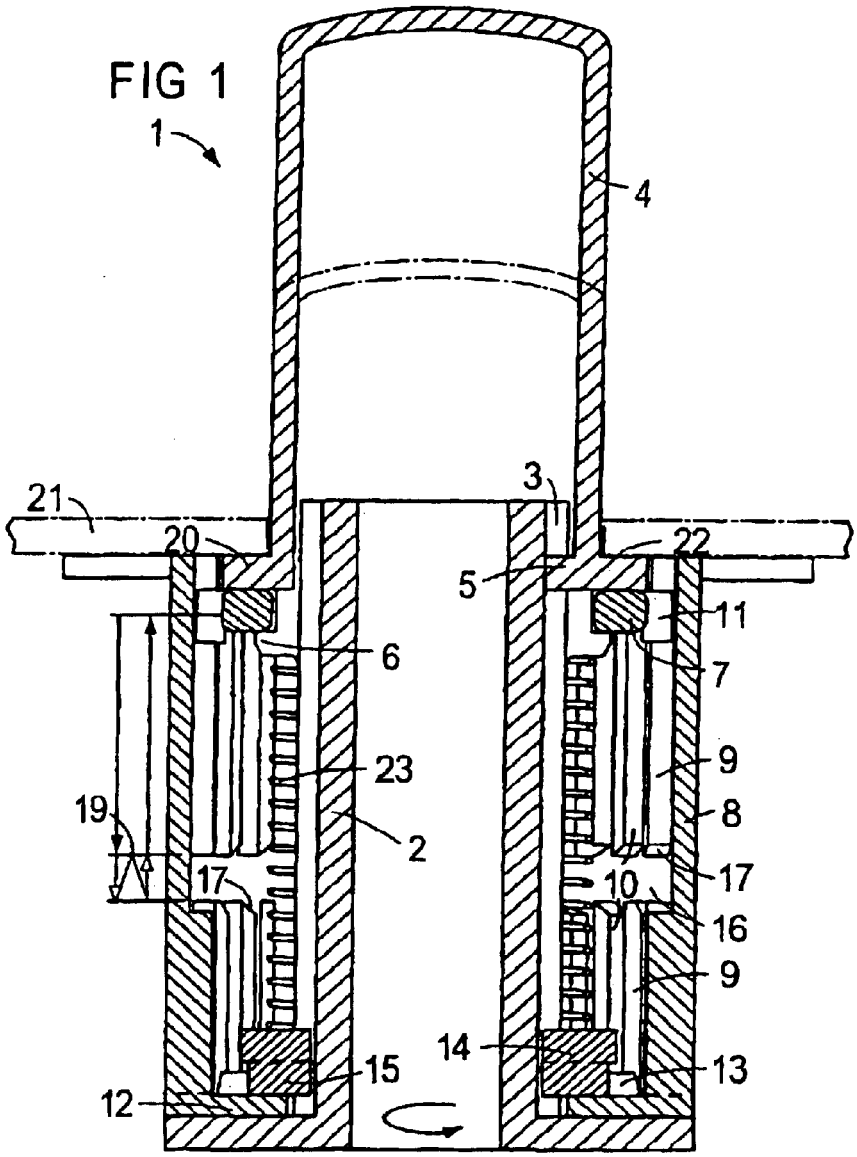
FIG. 1 shows a longitudinal section through an operating device with circular distributed link elements.

According to FIG. 1, an operating device 1 has a central, axially fixed rotor 2 for driving a not illustrated rotary instrument that is positioned underneath. The rotor is equipped with exterior longitudinal notches 3, into which a bonnet-shaped push knob 4 with at least one catcher 5, which protrudes into the interior, engages in an axially relocatable and pivot-proof manner. On the bottom side of the push knob 4, a multitude of axially protruding, circular distributed snap or latch hooks 6 are attached, which face the exterior, and on which a locking ring 7 is axially fixed and pivoted.

The rotor 2 is received in a cylinder-shaped body 8, on the interior wall of which circumferentially distributed longitudinal ligaments 9 are molded, which are embodied in a center section as fixed link elements 10 of a rotatory link drive. The locking ring 7 has cam-like movable link elements 11 that protrude toward the exterior in a circular distribution, which engage between the fixed link elements 10, and together with the same, form the link drive. The longitudinal ligaments 9 are interrupted in the center section, and release a ring-shaped circumferential track 16 for the movable link elements 11. At a lower bottom 12 of the body 8, a circumferential cam track is molded with cams 13 that reach toward the top. At this height, the rotor 2 is pivot-proof and axially relocatably surrounded by a latch ring 14 with latch cams 15 that protrude toward the bottom, which engage between the cams 13 in a ratchet-like manner. A coil pressure spring 23 is rigged between the lower latch ring 14 and the upper latch ring 6, which pushes the latch ring 14 toward the bottom, and the push knob 4 toward the top with a collar-like stop 20 against a stop shoulder 22 of an instrument panel 21 indicated by semi-colon lines.

In the position shown, the push knob 4 is pushed out of the flush latch position indicated by semi-colon lines into an operating position, in which it may be grabbed by the hand and adjusted. This adjustment is—under the ratchet effect of the latch ring 14—transferred to the rotor 2, and from the rotor, for example, to a not illustrated rotary potentiometer for the adjustment of the luminous intensity. Subsequently, the push knob 4 can be relocated into the area of the circumferential track 16 by picking up the circularly fixed locking ring 7.

Figure 2:
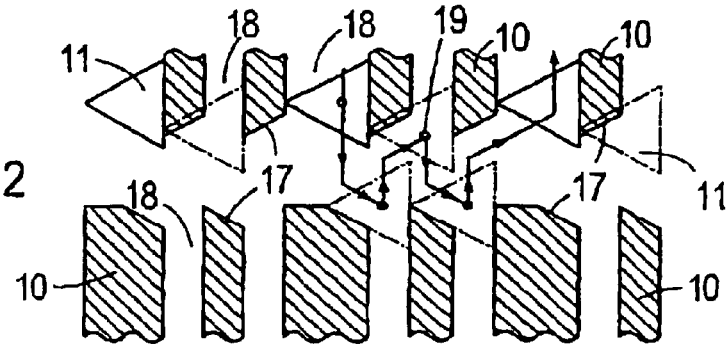
FIG. 2 schematically shows a partial contact arrangement of the link elements according to FIG. 1 in various positions of a movement cycle.

According to FIG. 2, the fronts of the longitudinal ligaments 9 that face each other have accumulation chamfers 17, which are aligned with corresponding counter chamfers of the trapeze-shaped movable link elements 11 of the locking ring 7 in such a way that the same are relocated into the same direction when the accumulation chamfers 17 are pushed. The longitudinal ligaments 9 arranged above the circumferential track 16 are offset and arranged at a clearance with respect to the bottom ones so that the movable locking elements 11 are safely rotated into the contact range of the respective next fixed locking element 10 by successively pushing and releasing the push knob 4.

Narrower and broader channels 18 are successively released between the upper longitudinal ligaments 9 as the movable link elements 11, which, in the broader ones can be relocated to the upper operating position, and which can rest at the narrower ones in the locking position 19. The different intermediate positions are marked by the link elements 11 indicated by the semi-colon lines, the movement track of which is indicated by the movement arrows.

Figure 3:
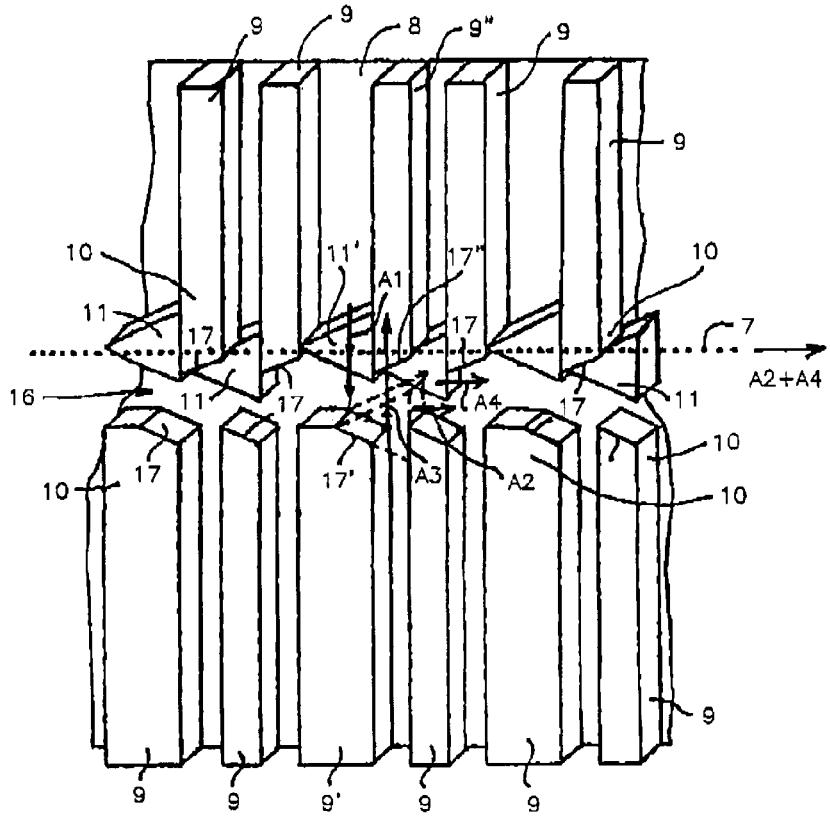
FIG. 3 depicts in greater detail the function of the movable link elements according to the present invention.

In connection with FIG. 3, the function of the movable link elements 11 is explained in more detail. For purposes of simplicity in explanation, the inner side of the cylinder-shaped body 8 is illustrated as being a plane wall.

The longitudinal ligaments 9 are connected to the cylinder-shaped body 8, and the movable link elements 11 are connected to the locking ring 7 (as shown by the dotted line) and protrude in the direction of the cylinder-shaped body 8.

When the locking ring 7 and the link elements 11 are pushed down, as shown by the arrow A1, the link element 11; is moved downwards until it engages at the chamfer 17' of the ligament 9' at the lower side of the track 16. This position is shown by broken lines. Thereby, the link element 11' and the locking ring 7 are rotated in the direction of the arrow A2.

When the locking ring 7 and the link element 11' are released, the link element 11' moves upward in the direction of the arrow A3 until it engages at the chamfer 17" of ligament 9" at the upper side of the track 16. Thereby, the link element 11' and the locking ring 7 are rotated in the direction of the arrow A4. In this way the locking ring 7 is rotated with each alternate and successive engagement of the link elements 11 with the upper and lower chamfers 17.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. An operating device for a flush operating knob that is axially locked and unlocked under spring load, for a rotary switch of an automobile, comprising:

a multiple toothed, circumferential link drive, in which a body of the operating device, and a locking ring that is axially fixed and pivoted on the operating knob have successively arranged, circumferentially distributed link elements in which the operating knob is axially lockable.

2. The operating device according to claim 1, wherein the locking ring has at least three movable link elements that are equally distributed across its circumference, and which are supported in a locking position on fixed link elements of the body.

3. The operating device according to claim 1, wherein fixed link elements are attached at an essentially hollow-cylindrical wall of the body radially facing toward an interior of said body, and that the movable link elements of the locking ring protrude radially toward an exterior to engage into the fixed link elements.

4. The operating device according to claim 1, wherein fixed link elements on said body are embodied of upper longitudinal ligaments and, offset therefrom, of lower longitudinal ligaments with frontal accumulation chamfers that face each other, a width of the upper longitudinal ligaments each corresponding to a width of channels embodied between the lower longitudinal ligaments, and vice versa.

5. The operating device according to claim 1, wherein fixed link elements of the body continuously extend to an exterior body edge of a hollow-cylindrical wall, said operating device being attachable to an assembly area in an instrument panel with said knob in its locked position, and said axially spring-loaded operating knob in its unlocked position being pushable via a stop shoulder against a collar-like stop of the instrument panel.

6. An operating device for a rotary switch with a flush operating knob that is extendable under spring load, comprising:

a body having a plurality of fixed link elements circumferentially distributed on an inner surface thereof; and a locking ring fitting within said body and being axially fixed and pivoted on said operating knob, said locking ring having successively arranged, circumferentially distributed movable link elements thereon that cooperate with said fixed link elements to form a multiple toothed circumferential link drive for axially locking and unlocking said operating knob.

7. The operating device according to claim 6, wherein the locking ring has at least three movable link elements that are equally distributed across its circumference and supported in a locking position on fixed link elements of the body.

8. The operating device according to claim 6, wherein said body has an essentially hollow-cylindrical wall with said fixed link elements thereon which radially face toward an interior of said body, said movable link elements of the locking ring protruding radially toward an exterior to engage into said fixed link elements.

9. The operating device according to claim 8, wherein said fixed link elements of the body continuously extend to an exterior body edge of said hollow-cylindrical wall.

10. The operating device according to claim 6, wherein said fixed link elements on said body include upper longitudinal ligaments and, offset therefrom, lower longitudinal ligaments with frontal accumulation chamfers that face each other, a width of each upper longitudinal ligament corresponding to a width of a respective channel between the lower longitudinal ligaments, and vice versa.

11. The operating device according to claim 6, wherein said operating device is attachable to an assembly area in an instrument panel with said knob in its locked position, and said axially spring-loaded operating knob in its unlocked position is pushable via a stop shoulder against a collar-like stop of the instrument panel.

* * * * *